US009348295B2

(12) United States Patent
Takatani

(10) Patent No.: US 9,348,295 B2
(45) Date of Patent: May 24, 2016

(54) PRINTING APPARATUS, METHOD FOR CONTROLLING PRINTING APPARATUS, AND STORAGE MEDIUM

(71) Applicant: CANON KABUSHIKI KAISHA, Tokyo (JP)

(72) Inventor: Tamotsu Takatani, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/581,863

(22) Filed: Dec. 23, 2014

(65) Prior Publication Data

US 2015/0185680 A1 Jul. 2, 2015

(30) Foreign Application Priority Data

Dec. 26, 2013 (JP) ..... 2013-269115

(51) Int. Cl.
*G03G 15/00* (2006.01)

(52) U.S. Cl.
CPC ..... *G03G 15/80* (2013.01); *G03G 15/5004* (2013.01)

(58) Field of Classification Search
CPC ..... G03G 15/5004; G03G 15/50; G03G 15/5083; G03G 15/5012; G03G 15/80
USPC ..... 399/75
See application file for complete search history.

(56) References Cited

U.S. PATENT DOCUMENTS

2004/0165029 A1* 8/2004 Park ..... B41J 2/165 347/23
2007/0253721 A1* 11/2007 Nakaue ..... G03G 21/203 399/27
2014/0186059 A1* 7/2014 Suzuki ..... G03G 15/5004 399/16

FOREIGN PATENT DOCUMENTS

JP H05-085020 A 4/1993
JP 11084836 A * 3/1999
JP 2013014082 A * 1/2013

* cited by examiner

*Primary Examiner* — Francis Gray
(74) *Attorney, Agent, or Firm* — Canon USA, Inc., IP Division

(57) ABSTRACT

A printing apparatus includes a printer unit a shift unit that shifts the printing apparatus from a first power state to a second power state when a power supply switch is turned off, and an obtaining unit that obtains predetermined time from the printer unit, wherein, when the power supply switch is turned on, switch-off time from turning-off of the power supply switch is compared to turning-on of the power supply switch with the predetermined time to shift the printing apparatus from the second power state to the first power state with executing initialization processing of the printer unit when the switch-off time is longer than the predetermined time, and the printing apparatus shifts from the second power state to the first power state without executing the initialization processing of the printer unit when the switch-off time is shorter than or equal to the predetermined time.

10 Claims, 4 Drawing Sheets

PRINTING APPARATUS, METHOD FOR CONTROLLING PRINTING APPARATUS, AND STORAGE MEDIUM

BACKGROUND

1. Field

Aspects of the present invention generally relate to a printing apparatus, a method for controlling the printing apparatus, and a storage medium.

2. Description of the Related Art

In recent years, as printing apparatuses have become multifunctional, systems have become complicated so that the time required to start up software has been increasing.

Japanese Patent Application Laid-Open No. 5-85020 discusses a technique established to address this issue. In this technique, when a power supply switch of a printing apparatus is turned off, only a dynamic random access memory (DRAM) is energized so that the DRAM keeps a status of software (system information) while the power supply is off. When the power supply switch is turned on next time, operation resumes starting from an image corresponding to the system information kept in the DRAM, so that the time required to start up the software is reduced (hereinafter referred to as "DRAM energization startup").

A printing apparatus typically includes a job controller unit (hereinafter referred to as "controller") that generates and processes a job and a print unit (hereinafter referred to as "printer apparatus") that executes print processing. The controller and the printer apparatus have respective central processing units (CPUs) to execute independent software. If the software of the controller performs the DRAM energization startup, in order to start up the entire system fast, the software of the printer apparatus needs to start up fast as well.

To start up quickly, the printer apparatus skips initialization of a plurality of devices provided in the printer apparatus. Such skipping of the initialization results in, for example, a reduction in time for stirring toner (a developer) contained in a developing unit included in a rotation driving load. When the initialization is skipped after the power supply is off for a long time, image quality of the printer apparatus may be affected. The technique discussed in Japanese Patent Application Laid-Open No. 5-85020 switches the initialization of the printer apparatus. In this technique, the printer apparatus switches the initialization by referring to a table provided beforehand therein, in response to detection of a key press at an operation unit. Therefore, the initialization of the printer apparatus cannot be switched dynamically in conjunction with operation of the controller.

SUMMARY

Aspects of the present invention are generally directed to a printing apparatus, a method for controlling the printing apparatus, and a storage medium, which are capable of dynamically switching an initialization processing method of the printer according to a method for starting up a system that controls the printing apparatus.

According to an aspect of the present invention, a printing apparatus includes, a printer unit, a control unit configured to control the printer unit, a shift unit configured to shift the printing apparatus from a first power state to a second power state when a power supply switch is turned off, and an obtaining unit configured to obtain predetermined time from the printer unit, wherein, when the power supply switch is turned on, the control unit compares switch-off time from turning-off of the power supply switch to turning-on of the power supply switch with the predetermined time obtained by the obtaining unit, to shift the printing apparatus from the second power state to the first power state after executing initialization processing of the printer unit when the switch-off time is longer than the predetermined time, and to shift the printing apparatus from the second power state to the first power state without executing the initialization processing of the printer unit when the switch-off time is shorter than or equal to the predetermined time.

Further features of the present disclosure will become apparent from the following description of exemplary embodiments with reference to the attached drawings.

DESCRIPTION OF THE EMBODIMENTS

Various exemplary embodiments, features, and aspects will be described in detail below with reference to the drawings.

Description of System Configuration

Figure 1A:
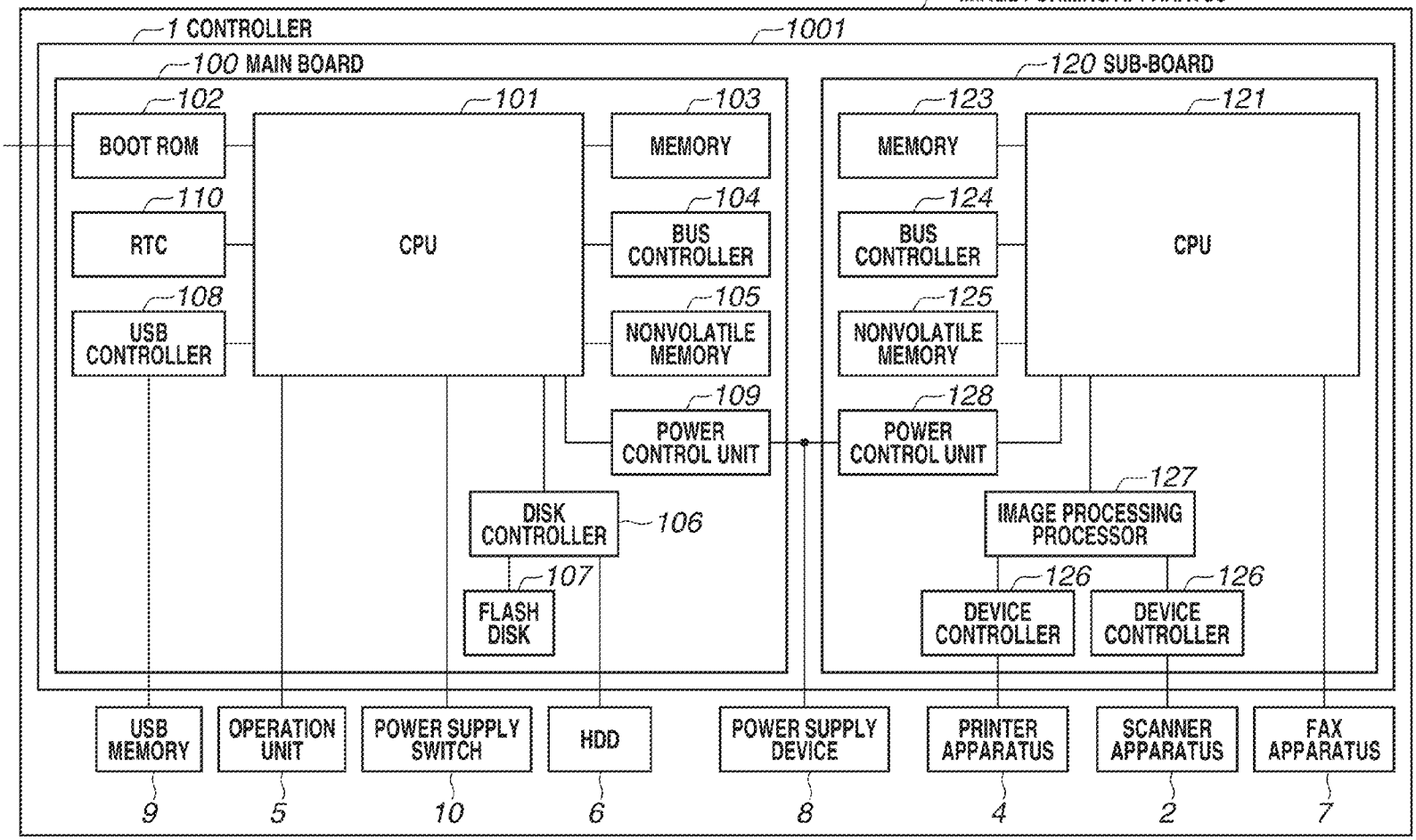
FIGS. 1A and 1B are block diagrams illustrating a configuration of an image forming apparatus.
Figure 1B:
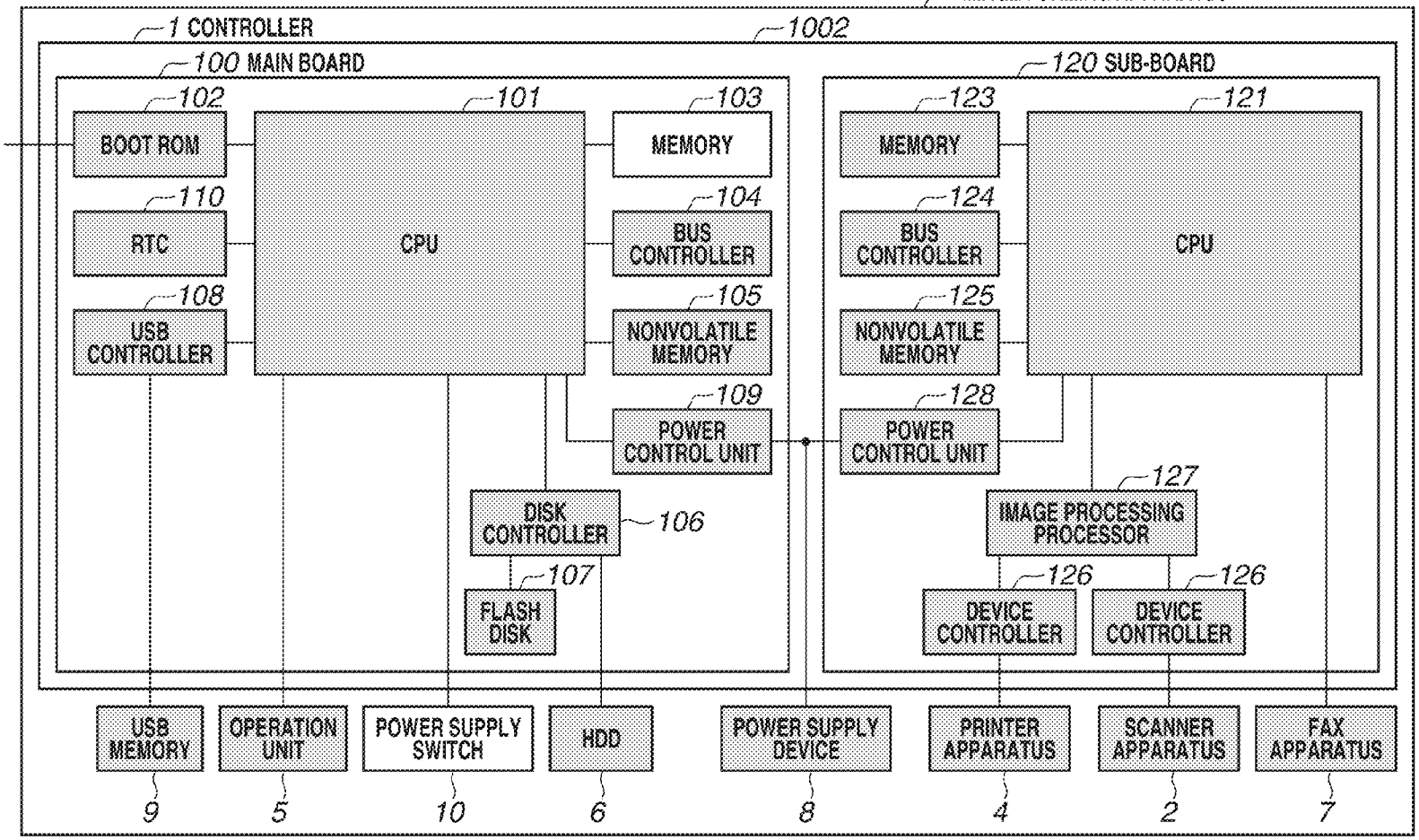

FIGS. 1A and 1B are block diagrams illustrating a configuration of an image forming apparatus according to a first exemplary embodiment. The image forming apparatus according to the present exemplary embodiment includes a controller unit having two boards. Further, FIG. 1A illustrates a stand-by state (a first power supply state) in which power is supplied to all devices. FIG. 1B illustrates a sleep state (a second power supply state) that is a power-saving state, in which power is lower than the power in the stand-by state, and the power supply to the shaded devices is stopped.

In FIG. 1A, a controller 1 includes a main board 100 and a sub-board 120.

The main board 100 is a general-purpose CPU system. A CPU 101 controls the entire main board 100. The CPU 101 controls boot processing by executing a boot program stored in a boot read only memory (ROM) 102. A memory 103 is a volatile memory such as a random access memory (RAM). A bus controller 104 is connected to a bus controller 124 of the sub-board 120. The bus controller 104 has a bridge function for an external bus. A nonvolatile memory 105 is configured not to lose stored contents even if the power supply is stopped. A real time clock (RTC) 110 is configured to keep time by using a battery, even if the power supply is stopped.

Further, the main board 100 includes a disk controller 106 and a flash disk 107 such as a solid state drive (SSD). The disk controller 106 controls a storage unit. The flash disk 107 is a storage unit including a semiconductor device and having relatively small capacity. A Universal Serial Bus (USB) controller 108 controls access to a USB memory 9 connected to the main board 100.

Furthermore, the USB memory 9, an operation unit 5, a hard disk drive (HDD) 6 are externally connected to the main board 100. The HDD 6 is not necessarily a hard disk as long as the HDD 6 is a storage unit. Any type of nonvolatile device may be employed as the HDD 6.

The sub-board 120 includes a relatively small general-purpose CPU system and image processing hardware. A CPU 121 controls the entire sub-board 120, and uses a memory 123 as a work memory. The sub-board 120 further includes the bus controller 124 having a bridge function for an external bus, and a nonvolatile memory 125 configured not to lose data even if the power supply is stopped. Furthermore, the sub-board 120 includes device controllers 126 and an image processing processor 127 that performs real-time digital image processing.

A scanner apparatus 2 sends digital image data to a printer apparatus 4 via the respective device controllers 126. The CPU 121 directly controls a fax apparatus 7.

Further, a power supply device 8 supplies predetermined power to each of the main board 100 and the sub-board 120. Power control units 109 and 128 control power supply to each unit requiring power on the main board 100 and to each unit requiring power on the sub-board 120, respectively.

A power supply switch 10 of the operation unit 5 can be operated by a user to turn on and off of power supply. When the power supply switch 10 is operated by the user, an interruption is input in the CPU 101. Upon detecting the interruption caused by the power supply switch 10, the CPU 101 controls the power control unit 109 according to the status. Meanwhile, the CPU 121 detects the operation of the power supply switch 10 via the bus controllers 104 and 124, and controls the power control unit 128.

For example, the CPUs 101 and 121 in FIGS. 1A and 1B each include many pieces of CPU peripheral hardware such as a chipset, a bus bridge, and a clock generator. The present exemplary embodiment is not limited to the image forming apparatus having a hardware configuration illustrated in FIGS. 1A and 1B.

Operation of the controller 1 illustrated in FIGS. 1A and 1B will be described below by taking, as an example, image copying using a sheet.

When the user makes an instruction to copy an image via the operation unit 5, the CPU 101 sends an image reading command to the scanner apparatus 2 via the CPU 121. The scanner apparatus 2 optically scans a paper original document, and converts the scanned paper original document into digital image data. The scanner apparatus 2 then inputs the digital image data into the image processing processor 127 via the device controller 126. The image processing processor 127 performs direct memory access (DMA) transfer to the memory 123 via the CPU 121, to store the digital image data temporarily in the memory 123.

Upon confirming that a predetermined amount or all of the digital image data has been stored in the memory 123, the CPU 101 issues an image output instruction to the printer apparatus 4 via the CPU 121. The CPU 121 informs the image processing processor 127 of the location of the image data in the memory 123. The image data on the memory 123 is transmitted to the printer apparatus 4 via the image processing processor 127 and the device controller 126 according to a synchronization signal sent from the printer apparatus 4. As a result, the printer apparatus 4 prints the digital image data on the sheet.

When performing printing of a plurality of copies, the CPU 101 saves the image data stored in the memory 123 into the HDD 6, so that the image data can be transmitted to the printer apparatus 4 for the second and subsequent copies without receiving the image data from the scanner apparatus 2. The printer apparatus 4 includes a developing unit containing a developer. Further, the printer apparatus 4 includes a plurality of loads to be subjected to rotation driving in initialization processing.

FIG. 1B illustrates a state in which power is supplied to the memory 103 and the power supply switch 10, and power is not supplied to other devices (the shaded devices in FIG. 1B). The memory 103 is configured of a DRAM in the block representing the controller 1 of the image forming apparatus.

In this state, only the memory 103 of the main board 100 of the controller 1 and the power supply switch are energized. When the power supply switch 10 is turned off by the user, a memory image present before the turning-off of the power supply is held in the memory 103. When the power supply switch 10 is turned on by the user, the CPU 101 returns a system state to the power supply state established before the shift to the sleep state, by using the memory image held in the memory 103.

In normal startup performed in a state in which the memory 103 configured of the DRAM is not energized, the time for reading a program from the HDD 6 into the memory 103 is necessary. On the other hand, in the sleep state in which the memory 103 configured of the DRAM is energized, the image forming apparatus resumes operation by starting from the system state stored in the memory 103. In this case, for the system as a whole, it is possible to reduce the startup time that corresponds to the time for loading the program from the HDD 6 into the memory 103. Therefore, this method is effective when a large-scale program is used.

Figure 2:
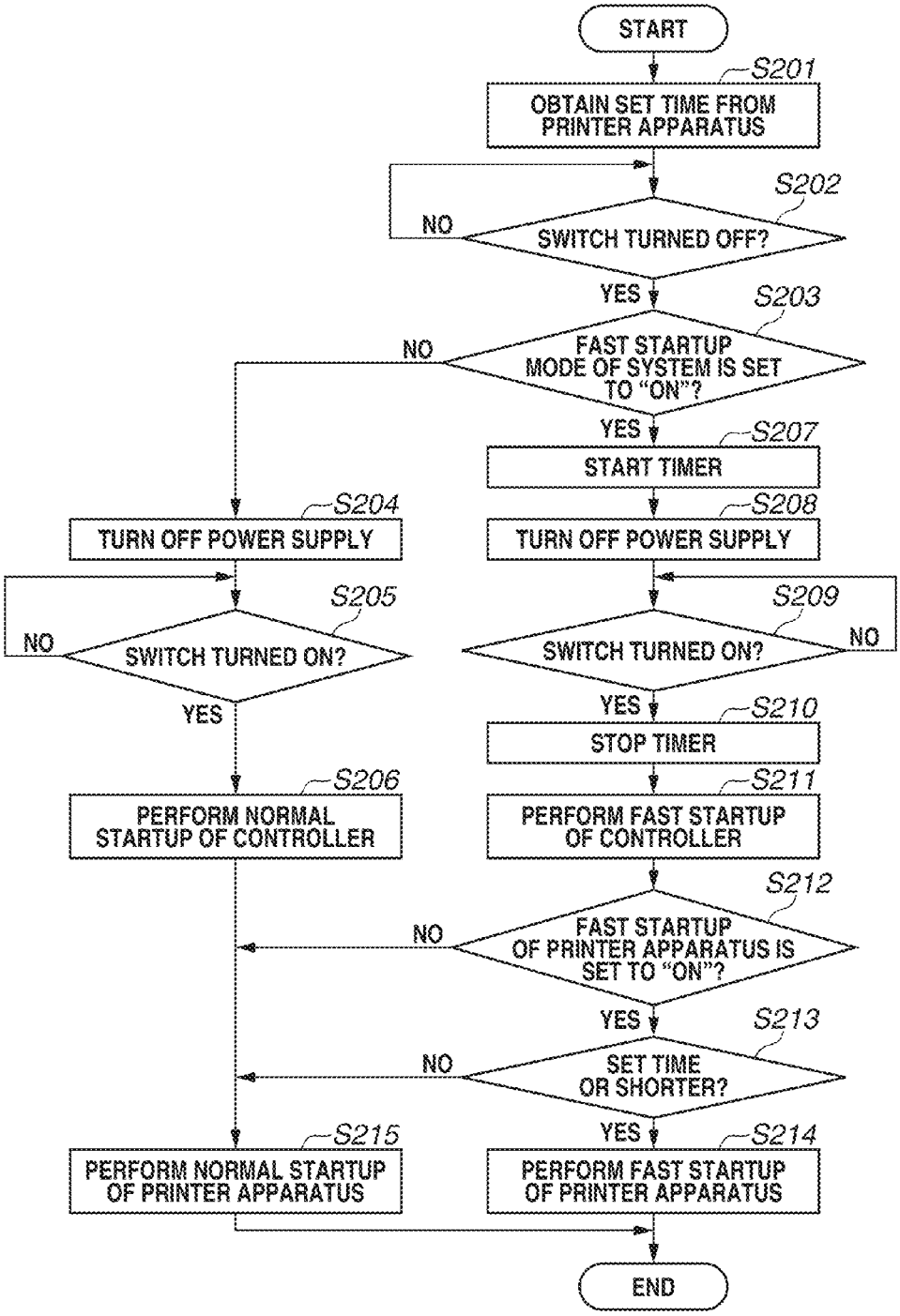
FIG. 2 is a flowchart illustrating a method for controlling the image forming apparatus.

FIG. 2 is a flowchart illustrating a method for controlling the image forming apparatus according to the present exemplary embodiment. The present exemplary embodiment illustrates an example of startup processing for the image forming apparatus based on a startup method for the image forming apparatus set by the user. The user sets this startup method, via a UI screen displayed on the operation unit 5, as will be described below. The CPU 101 loads a control program into the memory 103, and executes the loaded control program to implement each step.

Figure 3:
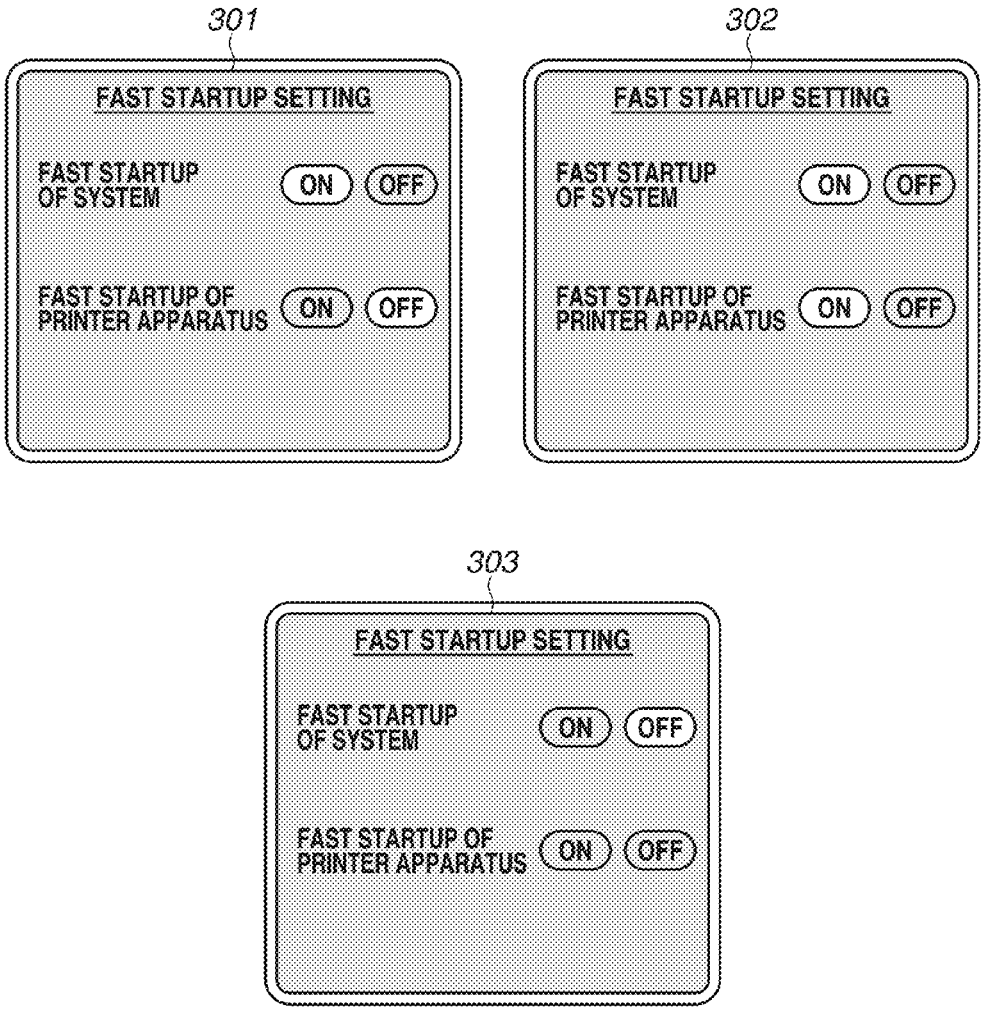
FIG. 3 is a diagram illustrating user interface (UI) screens that can be displayed on the image forming apparatus.

FIG. 3 is a diagram illustrating examples of the UI screen displayed on the image forming apparatus according to the present exemplary embodiment. FIG. 3 illustrates screens 301 to 303. The screen 301 corresponds to a case in which a fast startup mode of the system is set to "ON", and a fast startup mode of the printer apparatus 4 is set to "OFF".

Further, the screen 302 corresponds to a case in which the fast startup mode of the system is set to "ON", and the fast startup mode of the printer apparatus 4 is set to "ON".

Furthermore, the screen 303 corresponds to a state in which the fast startup mode of the system is set to "OFF", and options for the fast startup mode of the printer apparatus 4 are grayed out so that neither "ON" nor "OFF" can be selected.

In step S201, the CPU 101 obtains set time ST from the printer apparatus 4 via the device controller 126. The set time ST is set beforehand, to switch the startup processing in conjunction with the controller 1. In step S202, the CPU 101 determines whether OFF operation of the power supply switch 10 performed by the user is detected. Here, when the CPU 101 determines that the OFF operation of the power supply switch 10 provided on the operation unit 5 is detected (Yes in step S202), the processing proceeds to step S203. When the CPU 101 determines that the OFF operation of the power supply switch 10 is not detected (No in step S202), the processing in step S202 is repeated. The set time ST obtained in step S201 may be obtained beforehand and stored in a nonvolatile memory.

In step S203, the CPU 101 determines whether the fast startup mode of the system is set to "ON" as illustrated in the screen 301 or 302 in FIG. 3. When the CPU 101 determines that the fast startup mode is set to "ON" (Yes in step S203), the processing proceeds to step S207. When the CPU 101 determines that the fast startup mode is not set to "ON" (No in step S203), the processing proceeds to step S204.

In step S204, the CPU 101 establishes a power supply OFF state, by stopping the power supply from the power supply device 8 to the image forming apparatus, via the power control unit 109. At this moment, the controller is in the power supply state in which power is not supplied to all the blocks except the power supply switch 10 and the memory 103, as illustrated in FIG. 1B.

Next, in step S205, the CPU 101 determines whether ON operation of the power supply switch 10 provided on the operation unit 5 performed by the user is detected. Here, when the CPU 101 determines that the ON operation of the power supply switch 10 is detected (Yes in step S205), the processing proceeds to step S206. When the CPU 101 determines that the ON operation of the power supply switch 10 is not detected (No in step S205), the processing in step S205 is repeated.

In step S206, the CPU 101 loads a control program from the HDD 6 into the memory 103 and performs normal startup of the controller 1 in the system.

On the other hand, in step S207, the CPU 101 starts time measurement processing by starting a timer of the RTC 110, since the mode for performing the fast startup of the system (fast startup mode) has been instructed to be set to "ON", as indicated in the screen 301 or 302. Next, in step S208, the CPU 101 shifts the state to the power supply OFF state (sleep state), by stopping the power supply from the power supply device 8 to the image forming apparatus, via the power control unit 109. At this moment, the controller 1 enters the power supply state illustrated in FIG. 1B.

In step S209, the CPU 101 determines whether the ON operation of the power supply switch 10 provided on the operation unit 5 performed by the user is detected. When the CPU 101 determines that the ON operation of the power supply switch 10 is detected (Yes in step S209), the processing proceeds to step S210. When the CPU 101 determines that the ON operation of the power supply switch 10 is not detected (No in step S209), the processing in step S209 is repeated. Next, in step S210, the CPU 101 stops the timer of the RTC 110 started in step S207, to obtain elapsed time TD from the start of the time measurement processing in step S207 to the end of the time measurement processing in step S210.

In step S211, the CPU 101 starts the fast startup of the controller 1 from the state illustrated in FIG. 1B. In this case, the controller 1 starts up fast, because the status before the power supply OFF is held in the memory 103.

Next, in step S212, the CPU 101 determines whether the fast startup mode of the printer apparatus 4 is set to "ON" by the user on the screen 302 as illustrated in FIG. 3. When the CPU 101 determines that the fast startup mode is set to "ON" (Yes in step S212), the processing proceeds to step S213. When the CPU 101 determines that the fast startup mode is not set to "ON" (No in step S212), the processing proceeds to step S215.

In step S213, the CPU 101 compares the set time ST obtained in step S201, with the elapsed time DT from the start of the timer to the stop of the timer obtained in step S210, to determine whether the elapsed time DT is equal to the set time ST or shorter (DT≤ST). Here, when the CPU 101 determines that DT≤ST is satisfied (Yes in step S213), the processing proceeds to step S214. When the CPU 101 determines that the elapsed time DT exceeds the set time ST, i.e., that DT>ST is satisfied (No in step S213), the processing proceeds to step S215. In step S214, the CPU 101 causes the printer apparatus 4 to perform the fast startup, and the processing in this flow ends.

On the other hand, in step S215, the CPU 101 causes the printer apparatus 4 to perform normal startup processing accompanied by the initialization processing, and the processing in this flow ends.

In the fast startup, toner stirring operation and drum rotating operation to be performed in the normal startup are skipped to start up fast, and therefore, the total startup processing time is reduced.

Here, fast startup setting processing for the image forming apparatus will be described with reference to FIG. 3.

As illustrated in FIG. 3, buttons for setting ON/OFF for the fast startup of the entire system are provided in an upper part of each of the UI screens 301 to 303. Further, buttons for setting ON/OFF for the fast startup of the printer apparatus 4 are provided in a lower part of each of the UI screens 301 to 303.

When the user sets the fast startup of the entire system to "ON" (screen 301 and 302), the user can select the setting of the fast startup of the printer apparatus 4 between "ON" and "OFF".

On the other hand, when the user sets the fast startup setting of the system to "OFF" (screen 303), the buttons for selecting OFF/ON for setting the fast startup of the printer apparatus 4 are grayed to disable the selection. This is because the fast startup of the printer apparatus 4 is not required without the fast startup of the entire system.

According to the present exemplary embodiment, based on key operation performed in advance by the user on the operation unit 5, the printer apparatus 4 switches the initialization by referring to a table provided beforehand therein. As a result, the initialization of the printer apparatus 4 can be switched dynamically in conjunction with the operation of the controller 1.

The exemplary embodiment is not limited to a monofunctional printer apparatus, and may be applied to any type of apparatus if the apparatus can be combined with the printer apparatus. Examples of the apparatus include a multi-functional image forming apparatus having a reader function, and a facsimile apparatus.

According to the exemplary embodiment, an initialization processing method of a printer can be switched dynamically according to a method for starting up a system that controls an image forming apparatus.

Other Embodiments

Additional embodiments can also be realized by a computer of a system or apparatus that reads out and executes computer executable instructions recorded on a storage medium (e.g., computer-readable storage medium) to perform the functions of one or more of the above-described embodiment(s), and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that these exemplary embodiments are not seen to be limiting. The scope of the following claims is to be accorded the broadest interpretation so as to encompass all such modifications and equivalent structures and functions.

This application claims the benefit of Japanese Patent Application No. 2013-269115 filed Dec. 26, 2013, which is hereby incorporated by reference herein in its entirety.

What is claimed is:

1. A printing apparatus comprising:

a printer unit;

a power supply switch;

an obtaining unit configured to obtain comparison time from the printer unit, a comparison unit configured to, when the power supply switch is turned on, compare switch-off time from turning-off of the power supply switch to turning-on of the power supply switch with the comparison time obtained by the obtaining unit;

a control unit configured to execute toner stirring processing in the printer unit and shift the printing apparatus from a first power state to a second power state when the switch-off time is longer than the comparison time, and to shift the printing apparatus from the first power state to the second power state without executing the toner stirring processing in the printer unit when the switch-off time is shorter than or equal to the comparison time.

2. The printing apparatus according to claim 1, further comprising a storage unit configured to store status information indicating a status before the printing apparatus is shifted to the first power state, wherein, when the power supply switch is turned on, the control unit causes the printing apparatus to return from the first power state to the second power state, by using the status information stored in the storage unit.

3. The printing apparatus according to claim 2, wherein the storage unit is a volatile memory, and power is supplied to the volatile memory in the first power state.

4. The printing apparatus according to claim 1, further comprising a setting unit configured to set a startup method of the printer unit, wherein, in a case where the startup method set by the setting unit is fast startup, when the power supply switch is turned on, the comparison unit compares the switch-off time with the comparison time, and the control unit executes the toner stirring processing in the printer unit and shifts the printing apparatus from the first power state to the second power state when the switch-off time is longer than the comparison time and the control unit shifts the printing apparatus from the first power state to the second power state without executing the toner stirring processing in the printer unit when the switch-off time is shorter than or equal to the comparison time, and wherein, in a case where the startup method set by the setting unit is not the fast startup, when the power supply switch is turned on, the control unit executes the toner stirring processing in the printer unit and shifts the printing apparatus from the first power state to the second power state after.

5. A method for controlling a printing apparatus including a printer unit, a comparison unit, a control unit configured to control the printer unit, and a power supply switch, the method comprising:

obtaining a comparison time from the printer unit;

using the comparison unit to compare, when the power supply switch is turned on, switch-off time from turning-off of the power supply switch to turning-on of the power supply switch with the comparison time; and using the control unit to execute toner stirring processing in the printer unit and shifting the printing apparatus from a first power state to a second power state when the switch-off time is longer than the comparison time, and shifting the printing apparatus from the first power state to the second power state without executing the toner stirring processing in the printer unit when the switch-off time is shorter than or equal to the comparison time.

6. A printing apparatus comprising:

a printer unit;

a power supply switch;

an obtaining unit configured to obtain comparison time from the printer unit, a comparison unit configured to, when the power supply switch is turned on, compare switch-off time from turning-off of the power supply switch to turning-on of the power supply switch with the comparison time obtained by the obtaining unit;

a control unit configured to execute drum rotating processing in the printer unit and shift the printing apparatus from a first power state to a second power state when the switch-off time is longer than the comparison time, and to shift the printing apparatus from the first power state to the second power state without executing the drum rotating processing in the printer unit when the switch-off time is shorter than or equal to the comparison time.

7. The printing apparatus according to claim 6, further comprising a storage unit configured to store status information indicating a status before the printing apparatus is shifted to the first power state, wherein, when the power supply switch is turned on, the control unit causes the printing apparatus to return from the first power state to the second power state, by using the status information stored in the storage unit.

8. The printing apparatus according to claim 7, wherein the storage unit is a volatile memory, and power is supplied to the volatile memory in the first power state.

9. The printing apparatus according to claim 6, further comprising a setting unit configured to set a startup method of the printer unit, wherein, in a case where the startup method set by the setting unit is fast startup, when the power supply switch is turned on, the comparison unit compares the switch-off time with the comparison time, and the control unit executes the drum rotating processing in the printer unit and shifts the printing apparatus from the first power state to the second power state when the switch-off time is longer than the comparison time and the control unit shifts the printing apparatus from the first power state to the second power state without executing the drum rotating processing in the printer unit when the switch-off time is shorter than or equal to the comparison time, and wherein, in a case where the startup method set by the setting unit is not the fast startup, when the power supply switch is turned on, the control unit executes the drum rotating processing in the printer unit and shifts the printing apparatus from the first power state to the second power state after.

10. A method for controlling a printing apparatus including a printer unit, a comparison unit, a control unit configured to control the printer unit, and a power supply switch, the method comprising:

obtaining comparison time from the printer unit, using the comparison unit to, when the power supply switch is turned on, compare switch-off time from turning-off of the power supply switch to turning-on of the power supply switch with the comparison time obtained by the obtaining;

using the control unit to execute drum rotating processing in the printer unit and shift the printing apparatus from a first power state to a second power state when the switch-off time is longer than the comparison time, and to shift the printing apparatus from the first power state to the second power state without executing the drum rotating processing in the printer unit when the switch-off time is shorter than or equal to the comparison time.

* * * * *